US006189478B1

(12) United States Patent
Myers et al.

(10) Patent No.: US 6,189,478 B1
(45) Date of Patent: Feb. 20, 2001

(54) BOAT CARRIER WITH RETRACTABLE WHEELS

(76) Inventors: Clinton S. Myers, 300 Sleepy Hollow Rd. Lot 50, Douglas, GA (US) 31535; Norman M. MacKensie, 132 Convention Rd., Fitzgerald, GA (US) 31750

( * ) Notice: Under 35 U.S.C. 154(b), the term of this patent shall be extended for 0 days.

(21) Appl. No.: 09/361,101

(22) Filed: Jul. 26, 1999

Related U.S. Application Data

(60) Provisional application No. 60/094,181, filed on Jul. 27, 1998.

(51) Int. Cl.[7] ..... B63C 13/00
(52) U.S. Cl. ..... 114/344; 280/414.2
(58) Field of Search ..... 114/344, 364; 280/414.1, 414.2

(56) References Cited

U.S. PATENT DOCUMENTS

| | | | | |
|---|---|---|---|---|
| 2,042,598 | | 6/1936 | Harvey . | |
| 2,622,893 | | 12/1952 | Wasserlein . | |
| 2,831,203 | * | 4/1958 | Kanarr | 114/344 |
| 3,068,024 | | 12/1962 | Berliner . | |
| 3,101,203 | | 8/1963 | Raymond . | |
| 3,361,441 | * | 1/1968 | McRae | 280/47.32 |
| 3,955,830 | | 5/1976 | Hardwick . | |
| 4,214,774 | | 7/1980 | Kluge . | |
| 4,398,489 | | 8/1983 | Feola . | |
| 4,515,102 | | 5/1985 | Kury . | |
| 4,538,829 | | 9/1985 | Horowitz . | |
| 4,567,844 | | 2/1986 | Johnson . | |
| 4,601,481 | * | 7/1986 | Maurice | 280/47.331 |
| 4,766,838 | * | 8/1988 | Johnson | 114/363 |
| 4,830,387 | | 5/1989 | Batten . | |
| 4,936,595 | * | 6/1990 | Cunningham | 280/47.331 |
| 5,042,417 | * | 8/1991 | Raymond | 114/343 |
| 5,072,959 | | 12/1991 | Marullo . | |
| 5,197,405 | | 3/1993 | King . | |
| 5,261,680 | | 11/1993 | Freitus et al. . | |
| 5,501,169 | * | 3/1996 | Denker | 114/364 |
| 5,547,209 | * | 8/1996 | Vanderlinde | 280/414.2 |
| 5,560,629 | * | 10/1996 | Allard et al. | 280/414.2 |

* cited by examiner

*Primary Examiner*—S. Joseph Morano
*Assistant Examiner*—Andrew D. Wright
(74) *Attorney, Agent, or Firm*—John V. Stewart

(57) ABSTRACT

A boat carrier 1 having a transverse frame 2–2*a* with adjustable width for a range of boat widths, a gunwale clamp 10 at each end of the frame, a seat 11 in the middle of the frame, and a wheel 5 attached to each end of the frame by a strut 6–6*a*. The strut is pivotally attached to the frame by a pivot attachment 7 that is lockable vertically downward, vertically upward, or horizontally. A user can clamp the frame transversely between the gunwales of a boat at the longitudinal balance point of the boat. The wheels can be locked downward, and the boat can be rolled on land by a single person without lifting a significant weight, and can be launched into water. When afloat, a person in the boat can pivot the wheel struts to a horizontal position, placing the wheels beside the boat where they serve as bumpers and stabilizing outriggers. The wheels can optionally be locked upward for rolling the boat inverted on land. The wheel struts telescope to a desired wheel extension to set the boat carrying height. The carrier is designed to become a permanent part of the boat but can be quickly removed if desired.

8 Claims, 10 Drawing Sheets

FIG. 2
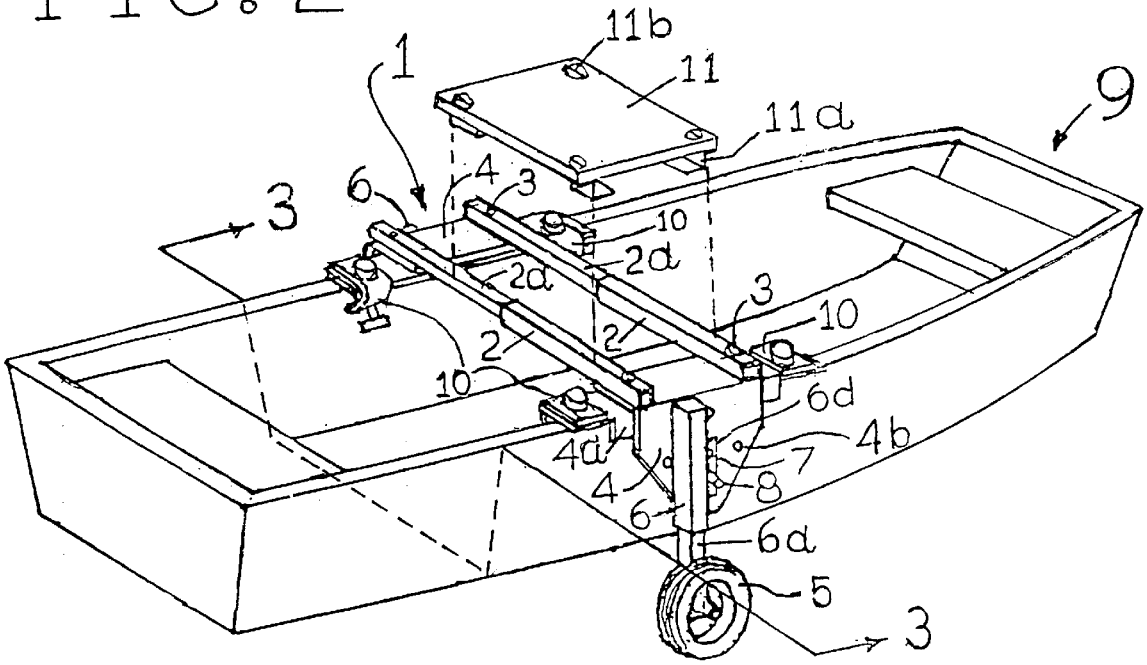
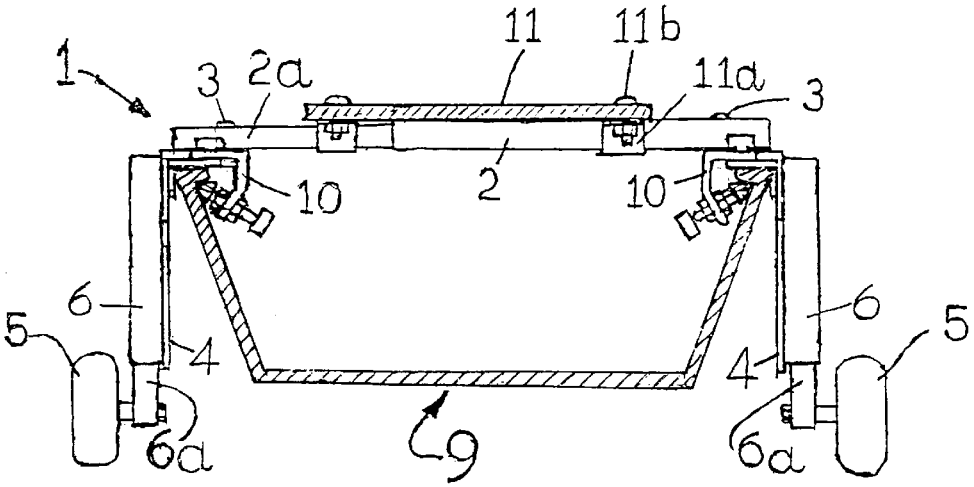
FIG. 3

BOAT CARRIER WITH RETRACTABLE WHEELS

CROSS-REFERENCE TO RELATED APPLICATIONS

This application claims the benefit of U.S. Provisional Application No. 60/094,181, filed Jul. 27, 1998.

BACKGROUND OF THE INVENTION

1. Field of the Invention

The present invention relates to wheel systems for transportation of boats overland, for launching boats in water, and for recovering boats from water, especially retractable wheel systems attached to small boats.

2. Description of Prior Art

Various wheeled boat carriers have been proposed for manually transporting small boats to and from the water's edge. While these carriers have served a particular purpose in each case, they have all had certain inherent disadvantages as discussed in the following paragraphs.

There are a number of prior boat-attached wheel systems designed for rapid, long distance, overland movement, exemplified by U.S. Pat. Nos. 2,622,893, 3,185,330, 3,733,628, and 4,515,102. These are mechanically complex and high in cost compared to the present invention.

U.S. Pat. No. 5,197,405 shows a boat-attached wheel system that positions both wheels as a single unit and stows them behind the transom, with no flexibility in choosing wheel position independently. This causes interference with transom-mounted motors and other apparatus such as "ski ropes". It is desirable to be able to operate each wheel position independently or together as the situation might dictate as the present invention.

U.S. Pat. No. 3,499,177 shows a boat-attached wheel system requiring that the boat be inverted to roll the boat on land or into the water. Since the boat cannot operate inverted in the water, it requires that the boat be inverted prior to water entry. This requires lifting or rolling the boat to an upright position, and carrying or sliding the boat into the water instead of simply rolling the boat into the water such as the present invention.

U.S. Pat. No. 5,261,680 shows a boat-attached wheel system that is not adjustable. It only fits one boat width, is not adjustable longitudinally to compensate for longitudinal changes in boat loading, does not have the ability to retract the wheel assemblies into horizontal or vertical positions, and requires storage of wheels inside the boat where they take up passenger space and may get the passenger(s) wet.

U.S. Pat. No. 4,515,102 shows a wheel-axle arrangement with a single operating position along the longitudinal axis of the host boat, due primarily to inflexible or permanent mounting. When a boat is unloaded or loaded from one end, the center of mass moves along its length. While supporting the boat on its wheels, the operator must bear a portion of the weight of the boat and contents, which is proportional to the distance between the boat's center of mass and the axle position of the wheel assemblies. This is not a problem with the present invention since the transverse frame and the wheel assemblies attached thereto can be quickly moved forward or backward, if needed, to reestablish a center of mass above the wheel axles. This prior invention also uses a more complex and expensive wheel suspension and pivot arrangement.

SUMMARY OF THE INVENTION

The basic objects of the present invention are to provide a simple, low cost wheel system for conveniently transporting a small boat on land, in an assembly that is quickly attachable to a boat without tools and without penetrating or damaging the boat in any manner, which can be positioned to support the boat at its longitudinal center of mass for manual transport on land by a single person, which has wheels that are retractable by a person in the boat to a position beside the boat, and which provides an additional seat in the boat.

These basic objectives and more are achieved by a wheeled boat carrier 1 having a transverse frame 2–2*a* with adjustable width for a range of boat widths, a gunwale clamp 10 at each end of the frame, a seat 11 in the middle of the frame, a telescoping wheel strut 6–6*a* pivotally attached to the each end of the frame by pivot attachment 7 that is lockable vertically downward, vertically upward, or horizontally, and a wheel at the end of each wheel strut. A user clamps the frame transversely between the gunwales of a boat at the longitudinal balance point of the boat. The wheels can be locked downward; the boat can be rolled on land by a single person without lifting a significant weight, and can be launched into water. When afloat, a person in the boat can pivot the wheel struts to a horizontal position, placing the wheels beside the boat where they serve as bumpers and stabilizing outriggers. The wheels can optionally be locked upward for rolling the boat inverted on land. The wheel struts telescope to a desired extension to set the boat carrying height. The carrier is designed to become a permanent part of the boat but can be quickly removed if desired. Optionally, oar locks and fishing pole cups can be added to the sides of the frame. The wheels can be removed in an emergency for use as lifesaving floats.

BRIEF DESCRIPTION OF THE DRAWINGS

FIG. 2 is a detailed perspective view of the boat carrier mounted on the gunwales of a boat.

FIG. 3 is a transverse section from FIG. 2, along line 3—3 illustrating the location of various elements of the boat carrier.

REFERENCE NUMBERS

1. Boat Carrier assembly.
2. Outer tube section of telescoping transverse frame.
2*a*. Inner tube section of telescoping transverse frame.
3. Side plate fastening bolt.
4. Boat Carrier side plate.
4*a*. A foundation plate for the gunwale clamps.
4*b*. Wheel strut positioning hole.
4*c*. A threaded hole in the foundation plate 4*a*.
4*d*. Bolts or rivets to fasten the foundation plate 4*a* to the side plate 4 or to fasten the assembly permanently to the gunwales of a boat if desired.
5. Wheel.
5*a*. Wheel axle bolt.
5*b*. Flat washer.
5*c*. Spacer to provide clearance between strut and wheel.
5*d*. Lock nut to secure wheel on axle.
6. Outer tube section of telescoping wheel strut assembly.
6*a*. Inner tube section of telescoping wheel strut assembly.
6*b*. Lock pin that positions outer tube and inner tube of wheel strut assembly relative to each other.
6*c*. Hole in inner tube of wheel strut for lock pin 6*b*.
6*d*. Wheel strut pivot plate attached to outer tube section of wheel strut assembly to pivotally mount the wheel strut to the side plate at selectable positions via pins 7 and 8.
6*e*. Wheel axle hole in inner tube of telescoping wheel strut assembly.
7. Pivot bolt or pivot pin for wheel struts.
8. Spring loaded locking pin that holds struts in desired position.
9. Typical "backyard" boat.
10. Gunwale clamp.
10*a*. Gunwale clamp threaded knob, upper.
10*b*. Gunwale clamp threaded knob, lower.
10*c*. Rubber bumper.
11. Seat foundation board or plate.
11*a*. Seat foundation board or plate clamp.
11*b*. Bolt for seat foundation board or plate clamp.
11*c*. Washer for clamp bolt.
11*d*. Lock nut for clamp bolt.
11*e*. Hole for clamp bolt
13. Boat carrier attachment strap.
14. Boat carrier attachment strap ratchet.

DESCRIPTION OF THE PREFERRED EMBODIMENTS

Figure 4:
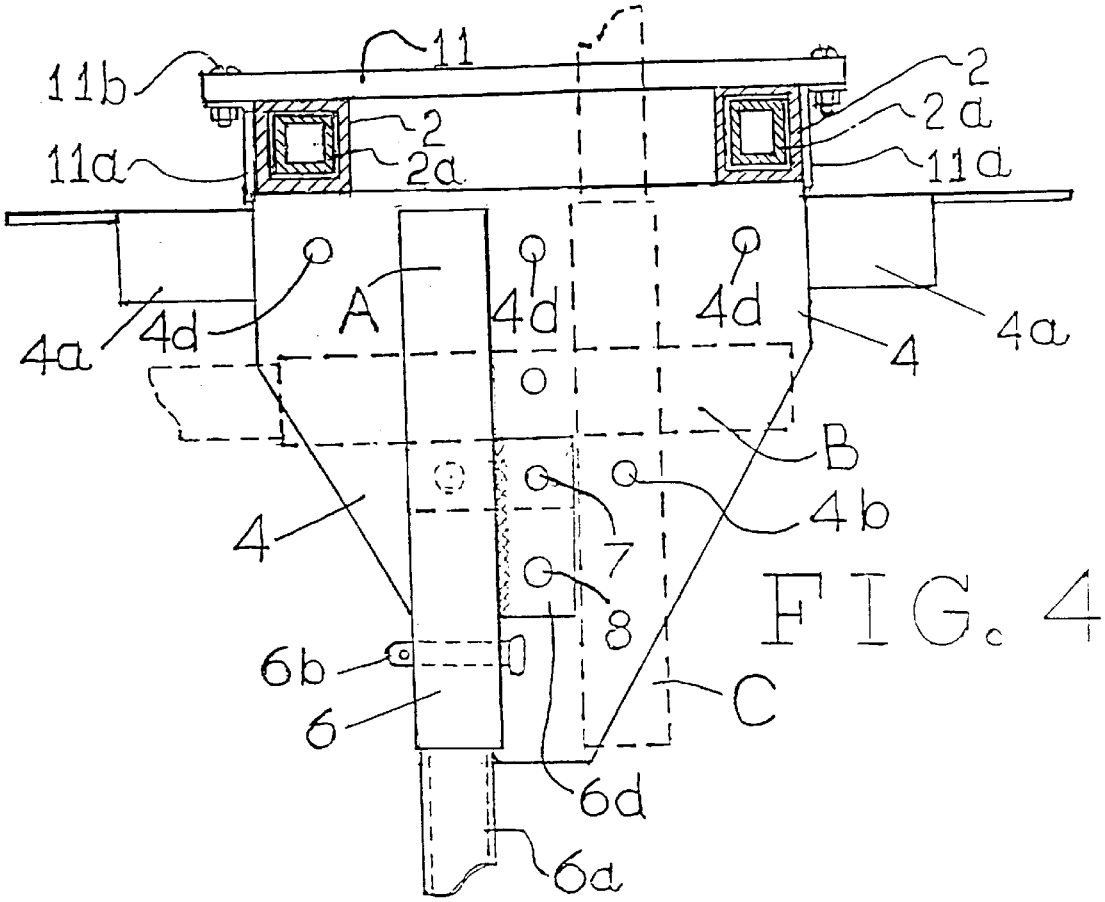
FIG. 4 is a detailed side view of the side plate 4, with the wheel strut assembly mounted in a downward position A on the side plate. Two alternate strut positions B, and C are shown in dashed lines.
Figure 8:
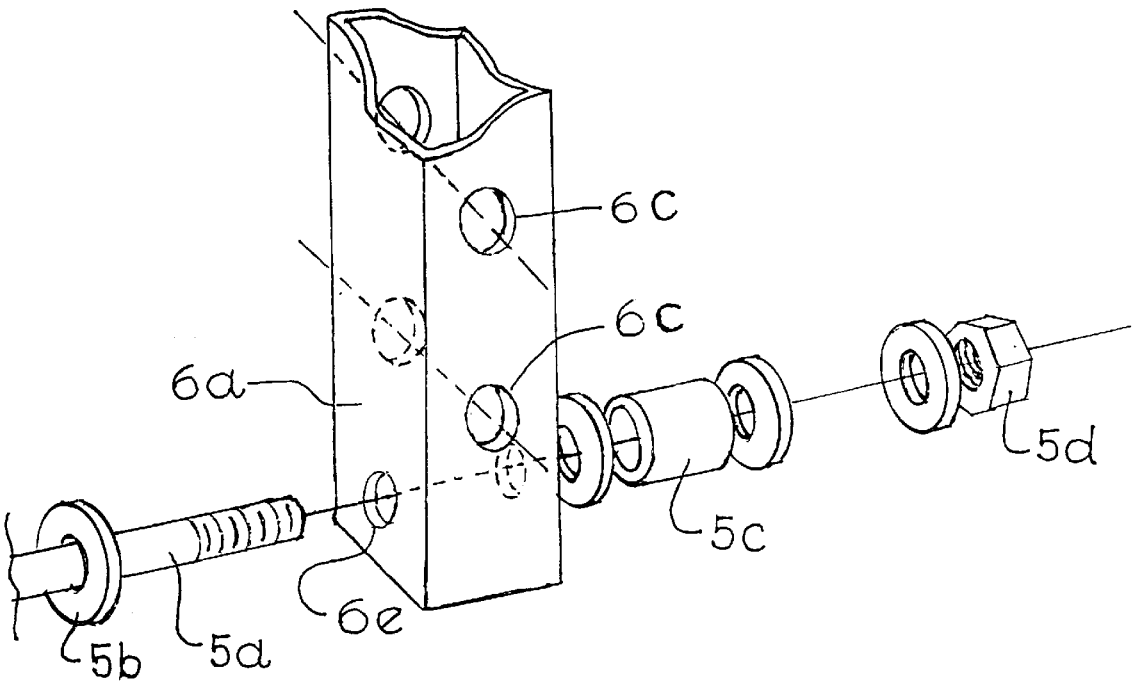
FIG. 8 is a perspective view of the bottom end of one of the wheel struts 6*a* of the boat carrier apparatus with an exploded view of the wheel axle components.
Figure 9:
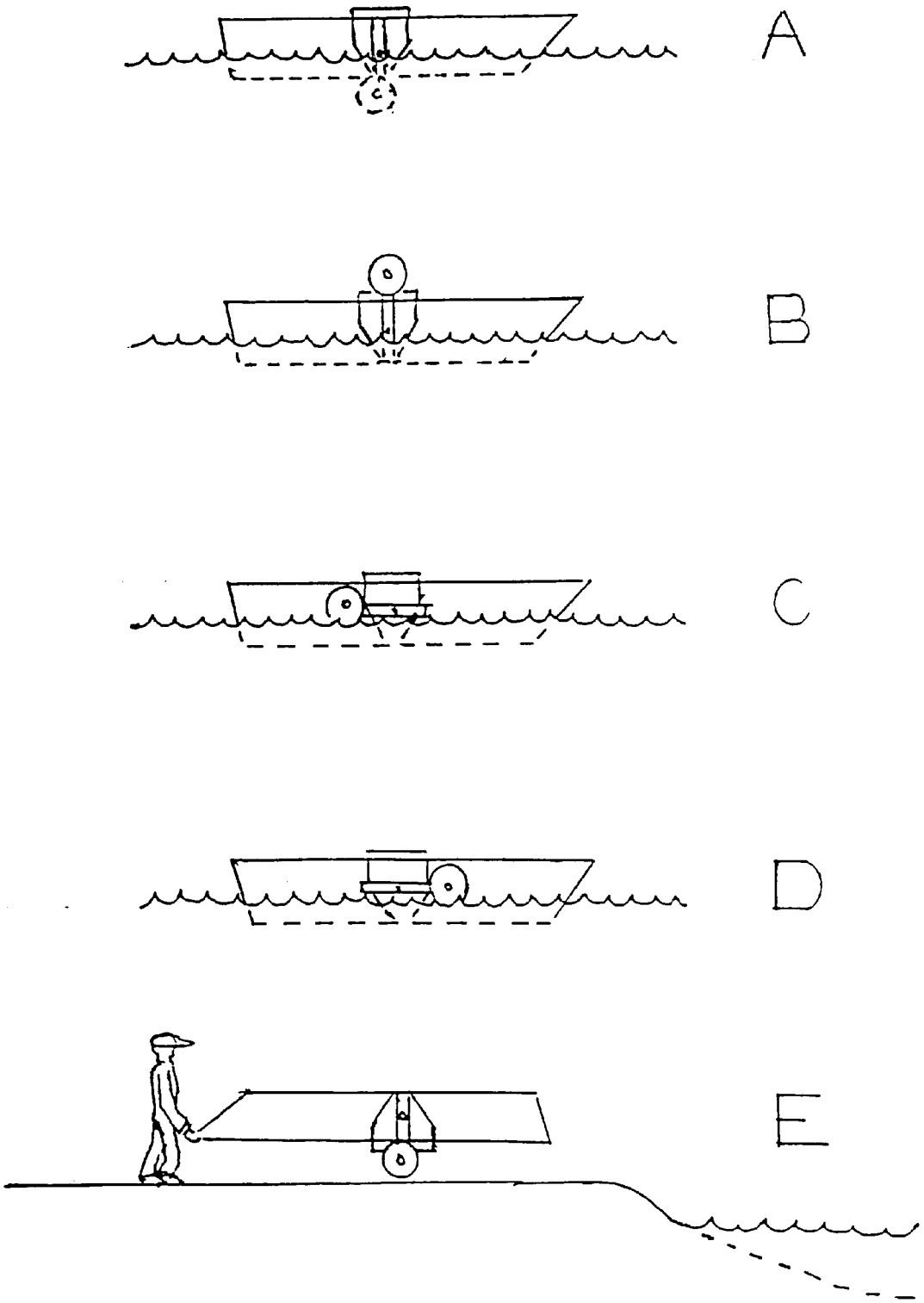
FIG. 9 is a side view of the boat carrier mounted on a host boat with the wheels and wheel struts shown in four different positions with the boat in the water, and with the boat inverted on land.

The invention shown in FIGS. 1–10 is a wheel system 1 with an adjustable frame 2–2*a* that mounts transversely across the top of a canoe, dingy, row boat, or similar watercraft, and rests on the gunwales of the boat. The frame is clamped to the boat gunwales by four clamps 10 that do not penetrate or damage the boat in any manner. Installation and removal is quick and simple. The system can be left permanently or temporarily attached to the boat as desired. Installation or removal requires only about five minutes, and no tools are required. The transverse frame is made up of lightweight metal or plastic tubes 2–2*a* that extend or telescope to provide adjustment for boats of different widths. This feature also allows the frame to be clamped at any longitudinal position on a given boat, so it can be located at the balance point of the boat. The tubes of the frame are held in position by a metal, plastic, or wood plate 11 that forms the foundation for a seat located on the vertical line through the center of mass of the boat. The transverse frame with the seat can be moved after installation by loosening the clamps and sliding it forward or aft to the desired location. The telescoping transverse tubes are attached to vertical side plates 4 by suitable means such as bolts, welding, or rivets. The side plates are the supporting elements for wheel struts 6. The wheel struts are located at each side of the boat with each strut assembly made of an upper strut 6 and a lower strut 6*a* with the lower strut telescoping into the upper strut to provide a means of adjusting the distance that the wheels are positioned below the side of the boat on land or water or positioned above the gunwale when operating on land in an inverted position. Single or multiple wheels 5 are attached to each lower strut by a suitable axle assembly 5*a*–5*d* (FIG. 8). Optional extra wheels provide more buoyancy in water or better foundation on land. The buoyant wheels provide stability for the boat when deployed horizontally (the outrigger principle) and provide drag to minimize drift when deployed under water. As shown in FIG. 4, the upper struts, one on the portside and one on the starboard side, are attached to the side plates by pivot bolts or pins 7 that form a means for the struts to pivot on the side plates and thus move the wheels to a desired position vertically down, horizontal, or vertically up. The struts are held in the position by spring-loaded locking pins 8 that are attached to the struts and penetrate holes 4*b* in the side plate when in the desired position. There can be as many wheel positions as there are holes in the side plates.

Figure 1:
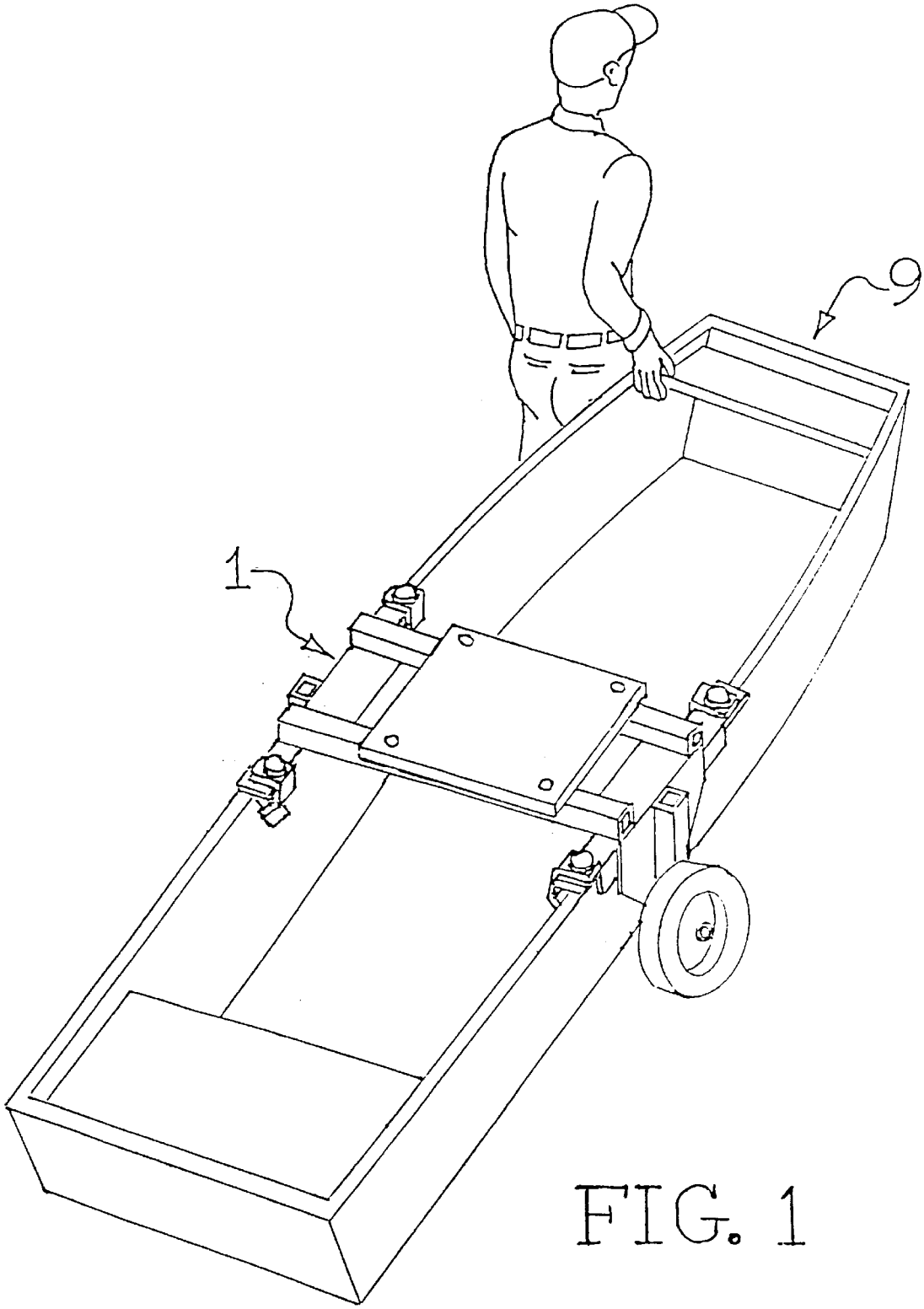
FIG. 1 is a perspective view illustrating the boat carrier being used to manually transport a typical small boat.

Once the transverse frame is attached to the host boat above the center of mass (COM), the boat has become balanced over the wheels, and the boat may be easily moved by one person as in FIG. 1 across terrain and in and out of water without having to lift any weight except that associated with inclines. The wheels and lower struts can be quickly positioned to place the wheels in the desired position below the boat. On rough terrain or tall ground cover, the boat can be raised by lowering the struts and wheels with a removable pin 6*b* that couples the lower strut to the upper strut. After the boat has been rolled into the water, the wheels may be left in a down and locked position to provide more flotation and stability (FIG. 9A). Or, they may be moved to a horizontal position (fore or aft as desired) where they are alongside the boat and above the water line (FIGS. 9C or 9D). In this position the boat carrier does not interfere with outboard motors, oars, paddles, trolling motors, or in any way with operating the boat. The horizontal wheel position further provides bumpers for docking and buoyant stability as the boat tries to roll causing the wheel(s) to start to submerge. If the operator desires to operate in water without the wheels, they can be quickly removed and placed in the boat or left on shore by pulling the strut pin 6*b*. All removable parts are tied to the side plates by small chains to prevent loss in water. In an emergency, the wheels may be used as life preservers by removing pin 6*b* and releasing the lower strut 6*a* from the upper strut 6.

After returning the boat to shore, the wheels are rotated down by pulling the lock pin 8 and rotating the struts downward. When the wheels are down and locked, the boat is ready to roll out of the water. When out of the water, the boat can be left on the shore with the wheels down or rolled to a motor vehicle or a remote storage location. If desired, the wheels may be rotated upward with the wheels above the boat (FIG. 9E). The boat can now be inverted and moved or stored inverted on the wheels to protect the interior from weather and animals or to expose the boat exterior for maintenance.

Figure 10:
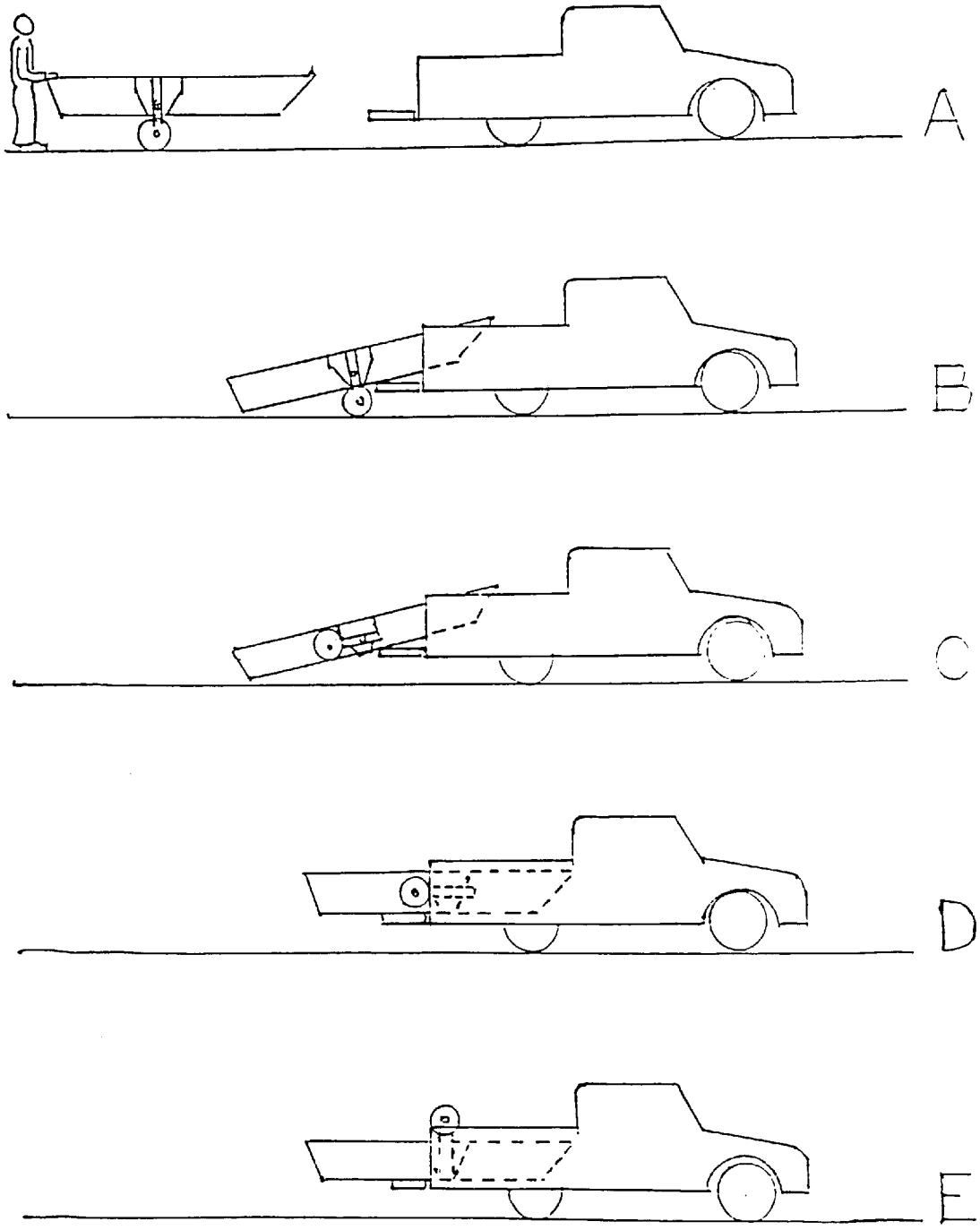
FIG. 10 shows the steps of loading a boat into the bed of a pickup truck using the present invention.

The design of the boat carrier makes loading and unloading of the boat on and off of pickup trucks and trailers a simple and quick operation for one operator as shown in FIG. 10. The boat is rolled up to the truck or trailer (FIG.

10A). The boat is then tilted nose-up, and moved forward until the bottom of the boat touches the tailgate of the truck or bed of the trailer (FIG. 10B). At this point, the boat is nearly balanced on the tailgate or trailer opening. Next, the wheels are placed horizontal (FIG. 10C). With little effort, the part of the boat that still remains outside the vehicle is lifted by the operator and pushed into the truck or trailer (FIG. 10D) and the boat is secured. If the carrier wheels are too wide for the truck bed, they may be rotated upward to clear the sides of the truck bed (FIG. 10E). Unloading is the reverse of these steps.

The boat carrier is inexpensive to manufacture and simple to install, with no tools needed for installation. The weight of the boat carrier is kept to a minimum through the use of lightweight but strong materials. This invention is needed by people with boats that they can no longer operate or move because of disabilities or infirmities associated with age or accidents or illnesses that will not permit them to lift and drag boats that are not balanced on wheels. The wheels eliminate the need to drag the boat, and the COM location removes the need to lift any significant weight.

Optionally, the ends of the transverse frame can have oar locks, fishing rod holders, and other accessories for use while the boat is in operation in water. The oar locks may be positioned longitudinally on the boat to a desired position by moving the boat carrier fore and/or aft by loosening the gunwale clamps and sliding the boat carrier to the desired location. The oar locks may be positioned on each end of the fore or aft tube of the transverse frame so they are positioned properly relative to a person in the seat provided.

Figure 5:
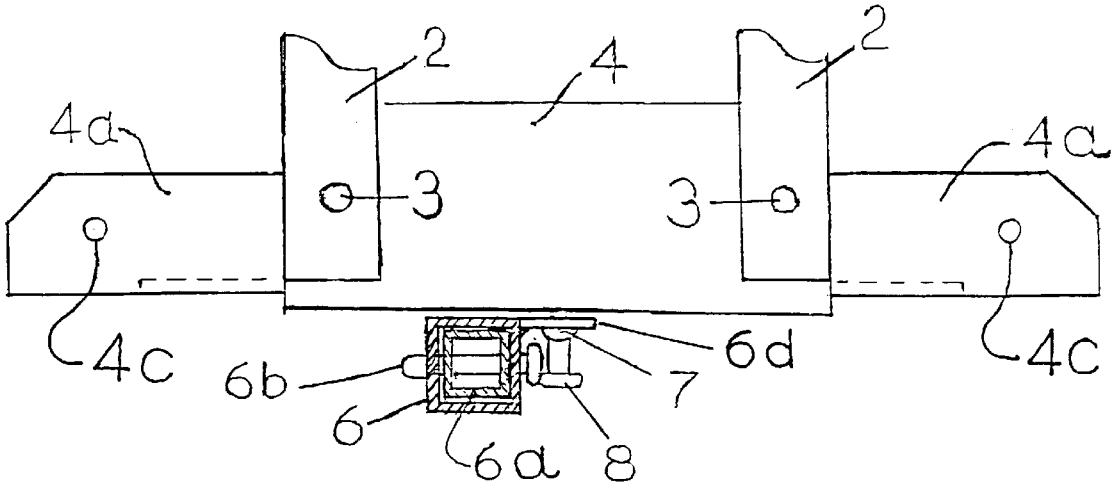
FIG. 5 is an illustration of the top view of FIG. 4, with the wheel strut in the vertical "down and locked" position.
Figure 6:
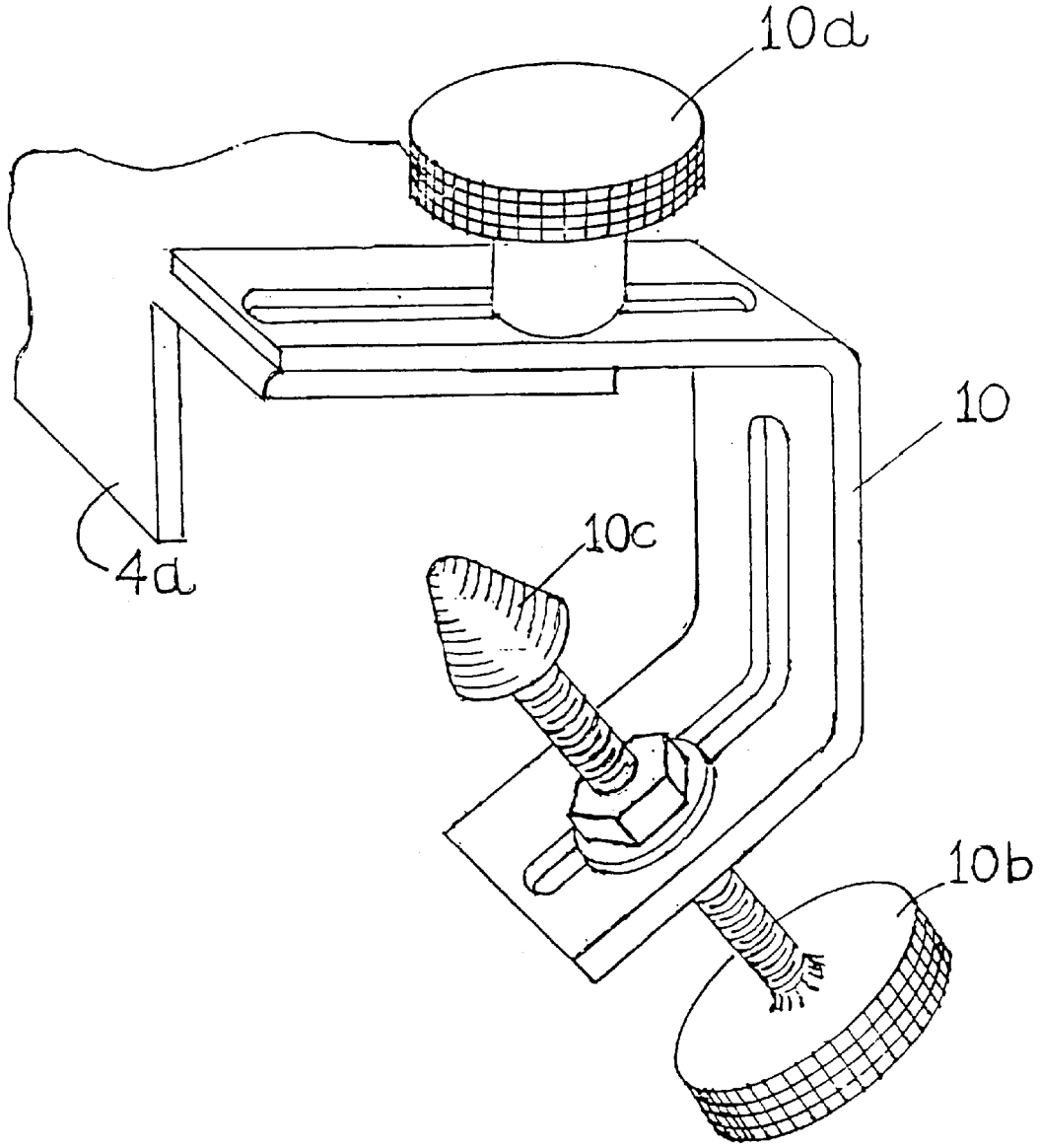
FIG. 6 is a perspective view of one of the clamps used to attach the boat carrier apparatus to the gunwales of the host boat.
Figure 7:
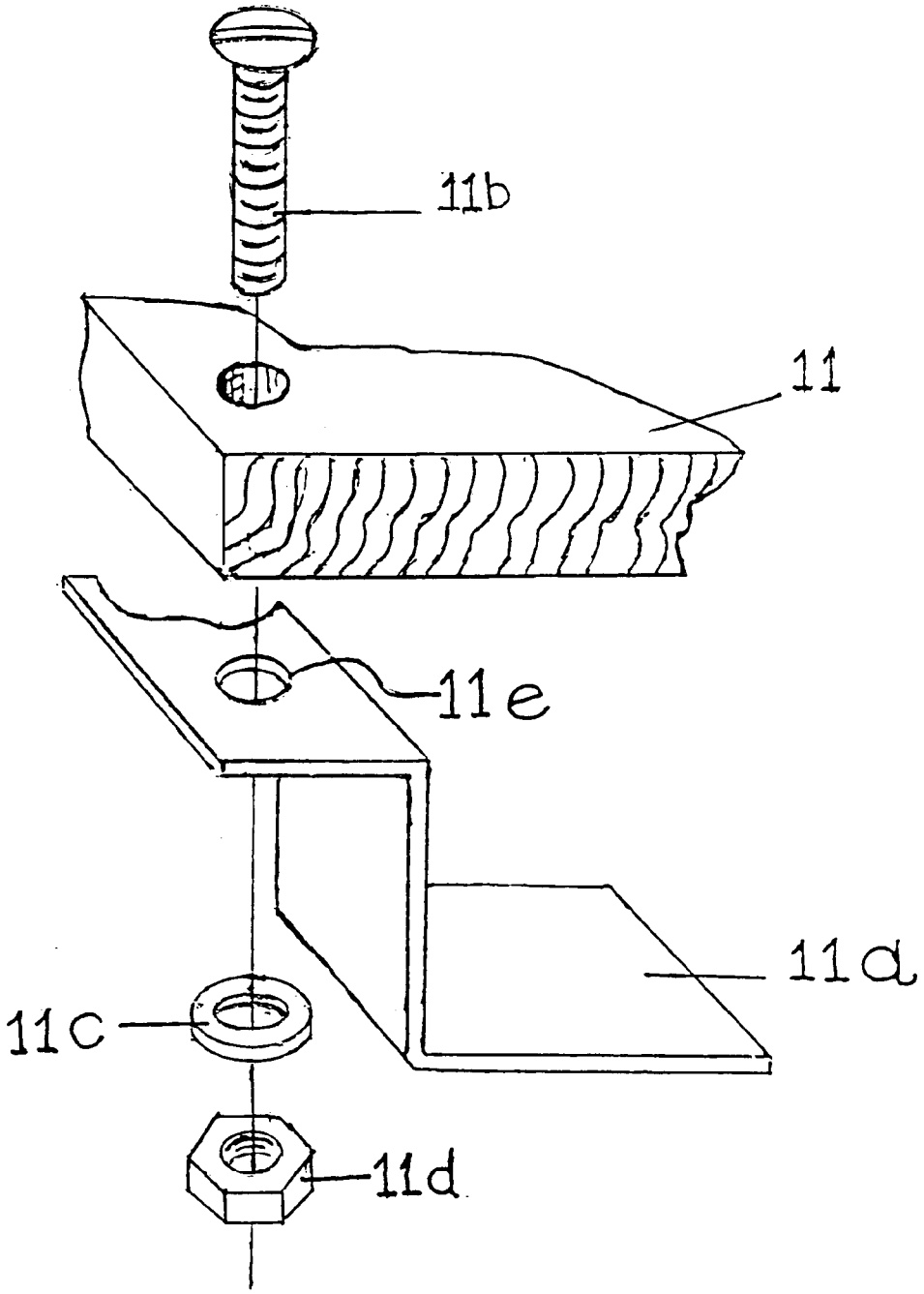
FIG. 7 is a perspective view of a section of the seat board and attaching clamp of the boat carrier apparatus.

In FIG. 1 and FIG. 2, the boat carrier 1 is shown mounted on a typical "backyard" boat 9. However, the invention is applicable to a variety of watercraft, including canoes, rowboats, dinghies, sailboats, and others. The boat carrier 1 of FIG. 2 has a transverse, telescoping, adjustable frame 2 and 2*a* with wheels 5, a seat 11, side plates 4 and 4*a* and wheel struts 6 and 6*a* attached thereto. The boat carrier 1 rests on the gunwales of a boat, above the center of mass (COM), where the frame 2 and 2*a* and its elements are clamped to the gunwales by clamps 10 (see FIG. 2 and FIG. 6) that do not penetrate or damage the boat 9 in any manner. Installation is quick and simple. The clamp 10 is fastened to a plate 4*a* by a threaded shaft with a knob 10*a*, which threads into a hole 4*c* on the horizontal surface of 4*a* (FIGS. 5 and 6). When this knob is loosened, clamp 10 can be moved toward or away from the gunwale as needed to fit the assembly to the gunwale design. Knob 10*b* is then tightened to clamp the rubber bumper 10*c* tightly against the bottom side of the gunwale. Further adjustment is provided by sliding the knob assembly 10*b* up or down in the slot provided to optimize the location and angle of the bumper 10*c*. Plate 4*a* is fastened to the side plate 4 using bolts or rivets 4*d* as in FIG. 4 or by welding, and extends fore and aft of the side plate 4 to provide a foundation for the clamps 10.

The boat carrier 1 can be left permanently clamped to the boat 9 or it can be removed at any time as quickly as it was attached. The frame 2 and 2*a* and the various attached elements may be constructed of a variety of materials which have a desirable high strength-to-weight ratio. These elements and the frame 2 and 2*a* may be made of aluminum, plastic, or graphite-based materials. Simplicity, cost, and safety are the key factors in final selection of materials, with safety being foremost.

The boat carrier can be permanently attached to a boat by the boat manufacturer or by a user. For example this can be done by passing the bolts or rivets 4*d* in FIG. 4 through holes drilled in the gunwales. In this case, the clamps 10 and the clamp foundation plates 4*a* can be eliminated.

The boat 9 may be transported across terrain in an upright or an inverted position by one person since the boat is balanced over the wheels 5, and the wheel position (up, down, or horizontal) is selectable by that person. FIG. 9A illustrates the wheels 5 in a downward locked position with the wheels under water. FIG. 9B illustrates the wheels 5 in an upward locked position, as they would be just prior to inverting the boat 9. FIG. 9C and FIG. 9D illustrate the wheels 5 in a horizontal locked position either fore or aft where they can act as outriggers for stabilization and as bumpers for protecting the boat while docking. FIG. 9E is an illustration of the boat after inversion from an upright position.

The inverted position presents the hull for maintenance and/or cleaning and protects the interior from rain and wind blown debris.

The person transporting the boat must only overcome rolling resistance when moving the boat since the weight factor has been removed by balancing the boat 9 over the wheels 5. Although a boat trailer is not needed when moving the boat 9 short distances over land with the present invention 1, a boat trailer may be used, if desired, to move the boat over roads and highways to the vicinity of operation. Then, in the absence of a boat ramp or other access to the water, the boat may be rolled to the water and into the water by an operator using the present invention 1.

Referring to FIGS. 2 and 3, the boat carrier 1 of the present invention comprises an expandable and retractable, telescoping, transverse frame 2 and 2*a* that fastens to vertical side plates 4 with bolts 3 or by welding or pinning. Telescoping wheel struts 6 and 6*a* are fastened to the vertical plates 4 by bolt or pin 7 of FIG. 2 and lock pin 8 (see FIG. 5). Wheels 5 are fastened to the lower end of the strut 6*a* by an axle 5*a* assembly as in FIG. 8. Bolt or pin 7 is installed in a manner that permits the strut-wheel assembly to rotate about the bolt or pin 7 using bolt or pin 7 as a pivot point.

Figure 11:
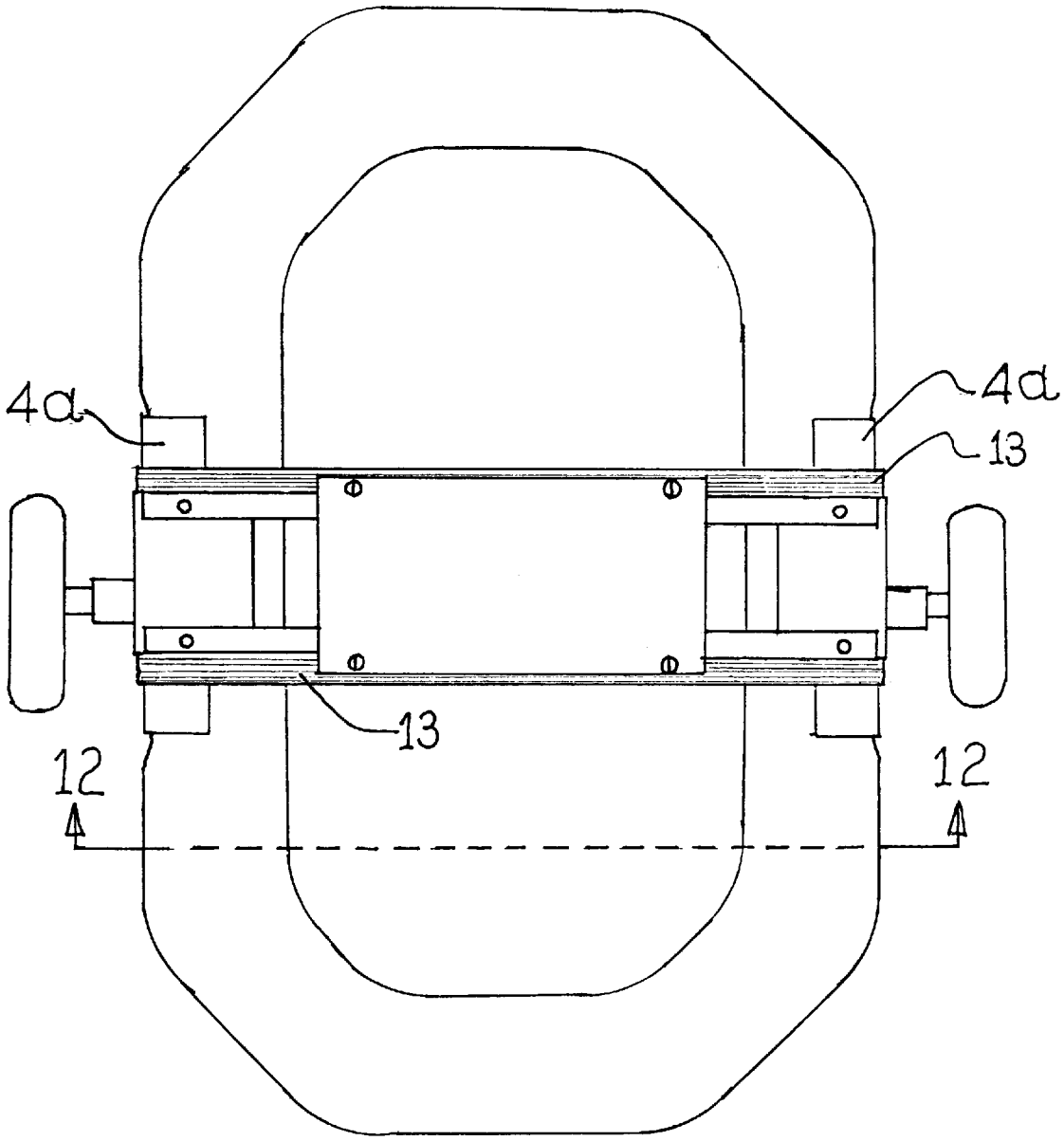
FIG. 11 shows a top view of the boat carrier mounted on an inflatable boat via straps 13.
Figure 12:
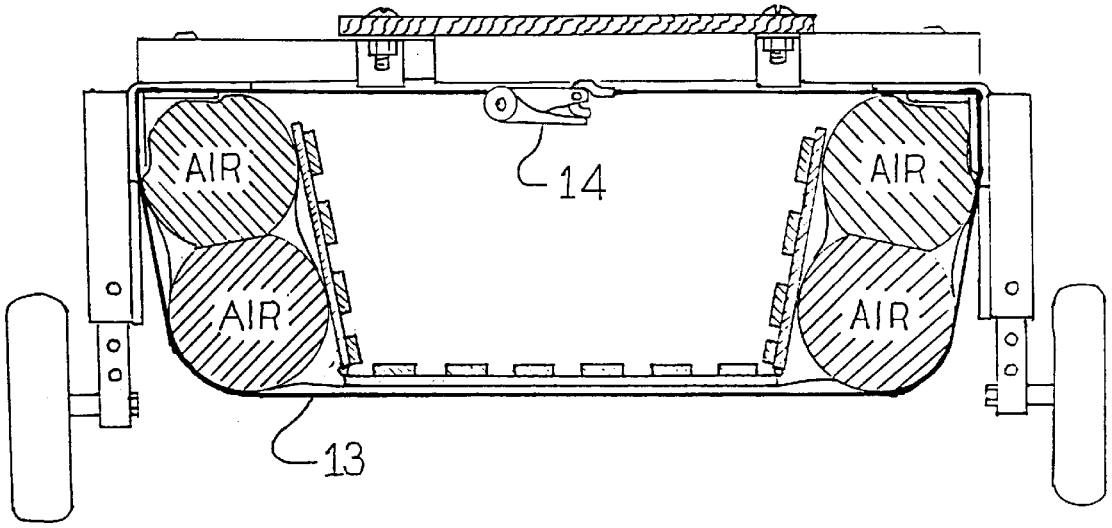
FIG. 12 shows a sectional view taken along line 12—12 of FIG. 11 showing the boat carrier mounted on an inflatable boat.

The boat carrier 1 is intended for manually transporting small boats 9 having a length in the range of 8 to 16 feet and a width in the range of 36 to 60 inches. However, the design can be adapted to larger boats by extrapolating the design to handle the increased length, width, and weight of the larger boat. Smaller craft can also be fitted with the boat carrier 1 by trimming the length of the transverse frame 2 and 2*a* to permit telescoping to a lesser width. The present boat carrier is the only design known to the inventors that can be used on rubber boats or rubber rafts where the gunwale is a large inflated tube as shown in FIGS. 11 and 12. This is accomplished by using two wide nylon straps that go under the boat or raft and come up the side of the craft and over the side plates 4 just fore and aft of the seat 11. Each strap has a ratchet assembly on one end. The other end of the strap is connected to the ratchet and securely tightened so that the craft is drawn up tight against the "side plate-frame" assembly. This approach replaces the gunwale clamps 10 of FIG. 6 and can be installed without tools. When in place, the straps are under the fore and aft edges of the seat 11 where they are out of the way and will not interfere with passengers, cargo, or operation of the craft. The straps can be of any material that is lightweight, strong, flexible, and durable in all anticipated environments. For best results, the rubber craft should be stiffened by framework inside of the craft that will keep the craft from collapsing when the straps are tightened. Most rubber craft are equipped with a floor framework when manufactured and some also include a framework to maintain the integrity of the boat shape.

Starting with the various elements or parts of the preferred embodiment of the present invention, assembly of the boat carrier 1 is as described in the following statements. A few tools will be needed to assemble the boat carrier 1 when first received. However, once the boat carrier 1 is assembled, no tools will be needed to install the boat carrier 1 on the boat 9. Start by fastening two frame members 2 to a side plate 4 with bolts 3 (see FIG. 2). Fasten two frame members 2*a* to a second side plate 4. Then slide the frame members 2*a* into frame members 2*a* minimum of six inches. Place the seat 11 on the frame assembly so that when the side plates 4 point down, the seat 11 will be on top of the frame. Fasten the seat 11 to the frame 2 and 2*a* as shown in FIG. 2 by using clamps 11*a* and bolts 11*b* (see FIG. 7). The side plates 4 are then spaced the desired distance apart by sliding frames 2*a* in or out of frames 2. When the desired distance is obtained, bolts 11*b* are tightened to prevent further movement of frames 2*a* relative to frames 2. The next step is to fasten the upper wheel struts 6 to the side plates 4 with bolts 7. The spring lock pin 8 is then installed and is used to hold the wheel strut 6 in position by inserting a spring loaded pin into a hole 4*b* in side plate 4.

Wheel struts 6*a* are then inserted into struts 6 so that the strut assembly (6 and 6*a*) has the desired length and will support the boat 9 the desired height above the terrain. Matching holes 6*c* in the struts 6 and 6*a* are used for the insertion of a pin 6*b* into hole 6*c* which fixes the position of the struts 6 and 6*a* relative to each other (FIG. 4). Pin 6*b* can also be seen in FIG. 5. Pin or bolt 7 provides the pivot point for the strut assembly 6 and 6*a* and can be seen in FIG. 2, FIG. 4, and FIG. 5. Three strut assembly positions are shown in FIG. 4. Position A holds the struts vertically with wheels 5 down and locked with lock pins 8. Position B holds the struts horizontally with wheels against the side of the boat 9 and held there by lock pins 8. Preferably two horizontal positions are provided, for holding the wheels forward or aft as desired. Position C holds the struts vertically with wheels above the gunwale and locked there by lock pins 8. The wheels 5 are attached to struts 6*a* as shown in FIG. 2, FIG. 3, and FIG. 8. In FIG. 8, a washer 5*b* is placed on bolt 5*a*. The bolt 5*a* with washer 5*b* is then inserted into hole 6*e* which is located near the bottom end of wheel strut 6*a*. Another washer 5*b* is then placed on the protruding bolt 5*a*, followed by a bushing 5*c* which is used to space the wheel 5 away from the strut 6*a*. A third washer 5*b* is then placed on the bolt following the spacer or bushing 5*c*. The wheel 5 is then slipped onto the bolt 5*a*, followed by a washer 5*b* and a lock nut 5*d*. The lock nut 5*d* is then tightened until all play is removed from the bolt stack and the bearings roll freely.

Although the present invention has been shown and described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

What is claimed is:

1. A boat carrier with retractable wheels, comprising:

a transverse frame comprising fore and aft substantially parallel horizontal tubes, each tube having left and right ends;

each tube being a two-part telescoping tube comprising an outer section and an inner section, the inner section nested within the outer section over part of the length of the inner section and part of the length of the outer section, making each parallel tube variable in length;

a seat foundation plate attached medially to the parallel tubes, spanning between them, holding the tubes substantially parallel to each other, the seat foundation plate laterally spanning the nested part of the length of each tube, and releasably locking the inner sections in relation to the outer sections;

a left side plate attached to the left ends of the tubes and extending downward from the tubes on a plane normal to the tubes;

a right side plate attached to the right ends of the tubes and extending downward from the tubes on a plane normal to the tubes;

a left gunwale clamp foundation plate attached to the left ends of the tubes, having a front end extending forward from the left end of the fore tube and a back end extending rearward from the left end of the aft tube;

a right gunwale clamp foundation plate attached to the right ends of the tubes, having a front end extending forward from the right end of the fore tube and a back end extending aft from the right end of the aft tube;

means for releasably securing the left gunwale foundation plate to the left gunwale of a boat and the right gunwale clamp foundation plate to the right gunwale of a boat;

a left wheel strut attached to the left side plate below the parallel tubes by a pivot attachment that is releasably lockable in at least 2 selectable positions, including downward and horizontal, about a pivot axis parallel to the tubes of the transverse frame;

a right wheel strut attached to the right side plate below the parallel tubes by a pivot attachment that is releasably lockable in at least 2 positions, including downward and horizontal, about a pivot axis parallel to the tubes of the transverse frame; and a wheel rotatably attached to each wheel strut on a rotation axis parallel to the parallel tubes of the transverse frame;

whereby the wheels can be releasably attached to a boat, pivoted downward for rolling transport of the boat on land, and pivoted into or out of a horizontal retracted position beside the boat by occupants within the boat while the boat is afloat.

2. In a boat having a bottom, a bow, a stern, and left and right sides, each side having a respective upper edge termed a gunwale, the improvement comprising:

a transverse frame comprising fore and aft substantially parallel tubes, each tube having a left end at the left gunwale and a right end at the right gunwale;

each tube being a two-part telescoping tube comprising an outer section and an inner section, the inner section nested within the outer section over part of the length of the inner section and part of the length of the outer section, making each tube variable in length;

a seat foundation plate attached medially to the parallel tubes, spanning between them, holding the tubes substantially parallel to each other, the seat foundation plate laterally spanning the nested part of the length of each tube, and releasably locking the inner sections in relation to the outer sections;

a left side plate attached to the left ends of the tubes and extending downward from the tubes on a plane normal to the tubes to a point below the left gunwale;

a right side plate attached to the right ends of the tubes and extending downward from the tubes on a plane normal to the tubes to a point below the right gunwale;

a left gunwale clamp foundation plate attached to the left ends of the tubes, having a front end extending forward from the left end of the fore tube and a back end extending rearward from the left end of the aft tube;

a right gunwale clamp foundation plate attached to the right ends of the tubes, having a front end extending forward from the right end of the fore tube and a back end extending aft from the right end of the aft tube;

means for releasably securing the left gunwale foundation plate to the left gunwale and the right gunwale clamp foundation plate to the right gunwale;

a left wheel strut attached to the left side plate below the gunwale by a pivot attachment that is releasably lockable in at least 2 selectable positions, including downward and horizontal, about a pivot axis parallel to the tubes of the transverse frame;

a right wheel strut attached to the right side plate below the gunwale by a pivot attachment that is releasably lockable in at least 2 positions, including downward and horizontal, about a pivot axis parallel to the tubes of the transverse frame; and a wheel rotatably attached to each wheel strut on a rotation axis parallel to the parallel tubes of the transverse frame;

whereby the wheels can be pivoted downward for rolling transport of the boat on land, and the wheels can be pivoted into or out of a horizontal retracted position beside the boat by occupants within the boat while the boat is afloat.

3. The boat of claim 2, wherein the means for releasably securing the gunwale foundation plates to the gunwales comprises a gunwale clamp on each end of each gunwale foundation plate, providing two gunwale clamps for each gunwale that are longitudinally spaced from each other along the gunwale by more than the distance between the parallel tubes.

4. The boat of claim 3 wherein the each gunwale clamp comprises:

a flat bar having a horizontal upper portion that is laterally adjustably attached to the respective end of the respective clamp foundation plate, the flat bar having a medial portion extending vertically downward, and a lower portion extending obliquely downward and angled toward the horizontal portion of the flat bar;

a gunwale engaging bolt releasably lockably attached to the flat bar through a slot passing along the flat bar from the medial portion through the lower portion, the gunwale engaging bolt having an engaging end under the upper portion of the flat bar; and a resilient bumper on the engaging end of the gunwale engaging bolt for engaging a surface of the gunwale;

whereby the clamp is adjustable as to the portion of the gunwale and angle on which clamping pressure is applied to the gunwale.

5. The gunwale clamp of claim 4 wherein the respective end of the respective foundation plate has a threaded hole with a vertical axis, the horizontal upper end of the flat bar has an elongated slot, and the flat bar is attached to the clamp foundation plate by a knob with a threaded shaft that is screwed into the threaded hole in the clamp foundation plate through the elongated slot.

6. The boat carrier of claim 2, wherein each wheel strut pivot attachment comprises a pivot plate attached to the respective wheel strut, a pivot bolt mounted through the pivot plate and the side plate, a plurality of lock holes in the side plate arranged around the pivot bolt, and an axially slidable lock pin attached to the wheel strut and slidable through a selected one of the lock holes in the side plate, whereby the pivot plate rotates 360 degrees about the pivot bolt and is rotationally fixed at selected locations by insertion of the lock pin through a selected lock hole in the side plate.

7. The boat carrier of claim 2, wherein the means for releasably securing the gunwale foundation plates to the gunwales comprises two straps, a fore strap encircling the boat around the front ends of the clamp foundation plates, and an aft strap encircling the boat around the back ends of the clamp foundation plates.

8. The boat carrier of claim 2, wherein each wheel strut is a two-part telescoping tube with two nested sections that are fixed in position relative to each other by a pin through both sections, and which can be separated by removal of the pin for removal of the wheel from the boat.

* * * * *